US005590848A

United States Patent [19]

Shore et al.

[11] Patent Number: 5,590,848

[45] Date of Patent: Jan. 7, 1997

[54] HIGH SPEED LAYING HEAD

[75] Inventors: Terence M. Shore, Princeton; Harold E. Woodrow, Northboro, both of Mass.

[73] Assignee: Morgan Construction Company, Worcester, Mass.

[21] Appl. No.: 566,611

[22] Filed: Dec. 4, 1995

Related U.S. Application Data

[63] Continuation-in-part of Ser. No. 233,315, Apr. 26, 1994, abandoned.

[51] Int. Cl.[6] ..... B21C 47/10; B21D 11/00

[52] U.S. Cl. ..... 242/361; 72/66; 72/135; 140/124

[58] Field of Search ..... 242/361; 72/66, 72/135; 140/124

[56] References Cited

U.S. PATENT DOCUMENTS

| | | | |
|---|---|---|---|
| 4,080,772 | 3/1978 | Chambley et al. | 242/361 X |
| 4,109,879 | 8/1978 | Properzi | 242/361 |
| 4,432,503 | 2/1984 | Wedler | 242/361 X |
| 4,765,556 | 8/1988 | Nassah | 242/361 |
| 5,033,689 | 7/1991 | Polomi | 242/361 |

FOREIGN PATENT DOCUMENTS 2912162 10/1980 Germany .

OTHER PUBLICATIONS

Kobe Steel Ltd., Patent Abstracts of Japan, vol. 17, No. 430, Aug. 10, 1993, JP5092869, published Apr. 16, 1993.

*Primary Examiner*—John Q. Nguyen
*Attorney, Agent, or Firm*—Samuels, Gauthier Stevens & Reppert

[57] ABSTRACT

A rolling mill laying head as a quill supported for rotation about its longitudinal axis between axially spaced first and second bearing assemblies. A laying pipe is carried by the quill for rotation therewith. The laying pipe has an entry section lying on the quill axis between the first and second bearing assemblies, and a three dimensionally curved intermediate section extending through and beyond the second bearing assembly to terminate at a delivery end spaced radially from the quill axis to define a circular path of travel. The dimension by which the laying pipe extends beyond the second bearing assembly is less than the diameter of the circular path.

4 Claims, 1 Drawing Sheet

HIGH SPEED LAYING HEAD

This is a continuation-in-part of application Ser. No. 08/233,315 filed on Apr. 26, 1994, abandoned.

BACKGROUND OF THE INVENTION

1. Field of the Invention

This invention relates generally to high speed rod rolling mills, and is concerned in particular with improvements in the laying heads used to form the hot rolled products of such mills into helical ring formations for deposit on cooling conveyors and the like.

2. Description of the Prior Art

A conventional laying head is depicted in FIG. 1 at 10. The laying head has a housing 12 and a quill 14 supported between first and second bearing assemblies 16, 18 for rotation about its axis "X". The centers of the bearings 16, 18 lie in respective reference planes $P_1$, $P_2$ spaced one from the other by a distance "B". The second bearing assembly 18 has a bore diameter "D".

Quill 14 carries a bevel gear 20 meshing with a larger diameter bevel gear 22, the latter being driven by conventional means (not shown). A laying pipe 24 is carried by the quill for rotation therewith. The laying pipe has an entry section $\mathbf{24}_a$ lying on the quill axis X between the first and second bearing assemblies 16, 18, and a three dimensionally curved intermediate section $\mathbf{24}_b$ leading from the entry section across reference plane $P_2$ to a delivery end $\mathbf{24}_c$. The delivery end is spaced from reference plane $P_2$ by an overhang distance "A", and is spaced radially from axis X to define a circular path of travel having a diameter "F". The laying pipe is held by a pipe support structure 26 comprising arms extending radially from the quill. Hot rolled product is directed into the entry section $\mathbf{24}_a$ of the laying pipe, and emerges from the delivery end $\mathbf{24}_c$ as a continuous helical formation of rings having diameters F.

With reference to FIG. 2, it will be seen that under static conditions, the rotating assembly comprising the quill, laying pipe and support structure deflects under its own weight "W" as indicated diagrammatically by the curve 28 (exaggerated for purposes of illustration). Thus, the centroid 30 of the rotating assembly will depart laterally from the axis of rotation X by a distance "Y". The extent to which lateral centroid deflection Y is minimized is considered to be a measure of the "stiffness" of the laying head.

It is generally accepted that a safe operating speed for a laying head is not more than about 65% of the critical resonance speed of the rotating assembly. Critical resonance speed varies inversely as the square root of the lateral deflection Y.

Laying heads are currently operating satisfactorily at mill delivery speeds on the order of 100–110 m/sec. However, as these speeds continue to increase to 120 m/sec and higher, the ability of conventional laying heads to function satisfactorily at these elevated speeds is projected to become increasingly problematical. The reason appears to be inadequate stiffness, which not only lowers the critical resonance speed of the rotating assembly, but also leads to the introduction of unacceptably pronounced vibrations.

The objective of the present invention is to achieve a marked increase in stiffness of laying heads, thereby overcoming the problems associated with the prior art and making it possible to meet the ever increasing speed demands of modern high speed mills.

SUMMARY OF THE INVENTION

The present invention stems from the determination that a primary contributing factor to inadequate laying head stiffness is the extent of overhang of the quill and laying pipe beyond the second bearing assembly. In conventional laying heads, the extent of overhang is invariably greater than both the diameter of the rings being formed by the laying head and the axial spacing between the first and second bearing assemblies. In accordance with the present invention, overhang is reduced to a fraction of these dimensions, thereby resulting in a stiffer construction which can be balanced more reliably and operated safely at higher speeds.

DESCRIPTION OF PREFERRED EMBODIMENT

Figure 3:
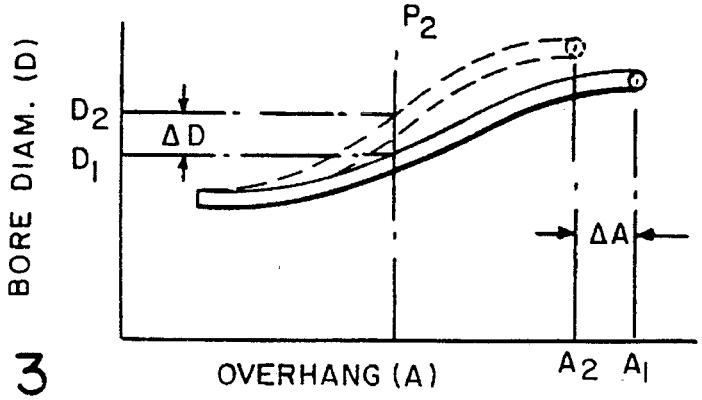
FIG. 3 is an illustration of the relationship of laying pipe overhang to the bore diameter of the second bearing assembly.

In the past, the spectre of speed induced bearing failures has influenced those skilled in the art to hold the so-called "$D_mN$ number" (Mean Diameter×RPM) of the second bearing assembly 18 to below about 1,000,000. Thus, as laying head RPM's have necessarily increased to keep pace with ever increasing mill delivery speeds, and in order to hold $D_mN$ ratings within what was perceived to be safe limits, bearing bore diameters were minimized. However, as shown in FIG. 3, the extent of laying pipe overhang A is a function of the bore diameter D of the second bearing assembly 18.

The present invention departs from conventional thinking by increasing the $D_mN$ rating of the second bearing assembly by as much as 50% to levels approaching 1,600,000. At these elevated $D_mN$ levels, increases in both RPM's and bearing bore diameters can be tolerated. The increased bore diameters make it possible to axially retract the curved intermediate section $\mathbf{24}_b$ of the laying pipe into the quill 14. Thus, as shown in FIG. 3, an increase $\Delta D$ in bore diameter from $D_1$ to $D_2$ will accommodate a decrease $\Delta A$ in overhang from $A_1$ to $A_2$. Any decrease $\Delta A$ in the overhang will result in a concomitant decrease in the distance "C" that the centroid 30 is spaced from the plane $P_2$ of the second bearing assembly. Since deflection Y is calculated as $$Y=WC^2B/3EI_1+WC^3/3EI_2$$

where, $I_1$=mean moment of inertia of quill cross section $I_2$=mean moment of inertia of pipe support cross section E=modulus of elasticity it will be seen that by decreasing C, Y will also be decreased, thereby increasing the stiffness and critical resonance speed of the laying head.

Figure 1:
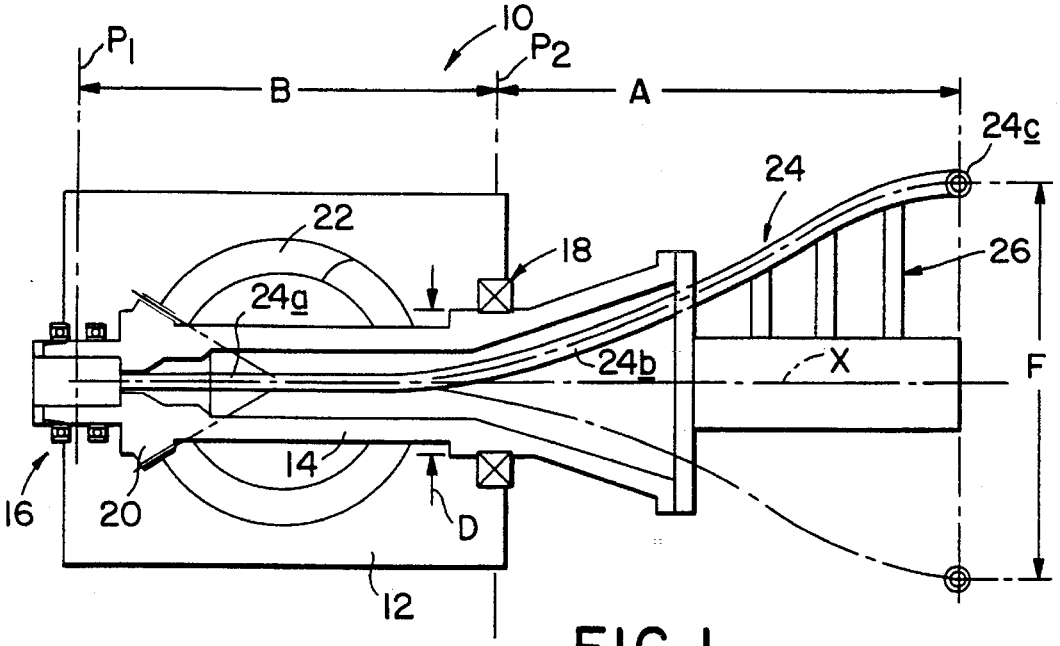
FIG. 1 PRIOR ART
FIG. 1 illustrates the principal components of a conventional rolling mill laying head.
Figure 2:
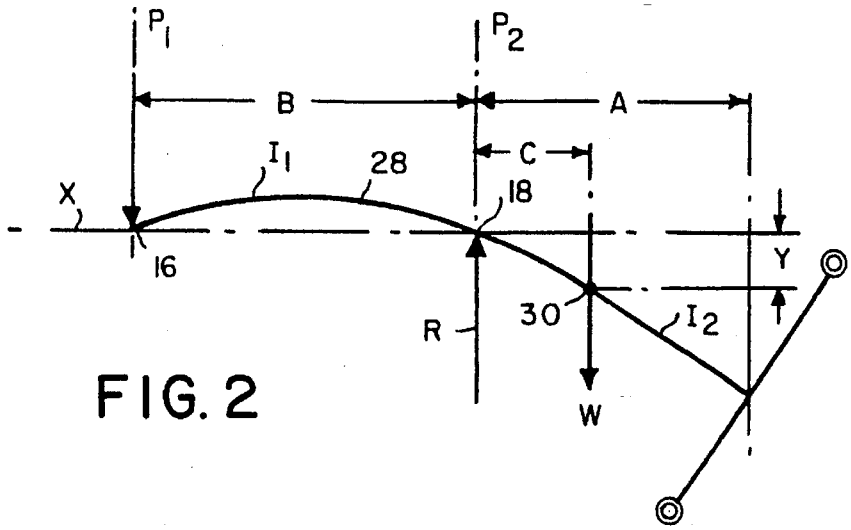
FIG. 2 is force diagram depicting the deflection of the rotating assembly of a laying head under static conditions.

In order to further reduce deflection Y for any given value of C, the spacing B between the first and second bearings 16, 18 also should be as small as possible. However, and again with reference to FIG. 2, it must be kept in mind that the load on bearing 18 is equal to the reaction "R" which can be expressed as $R=W(C/B+1)$ Thus, any decrease in B will increase the loading on bearing 18. This would normally not be a problem if the bearing were rated at conventional $D_mN$ numbers below about 1,000,000. However, at the elevated $D_mN$ ratings of the present invention, the number of bearing rolling elements must be reduced in order to accommodate lubricant penetration, thereby reducing the useful life of the bearing for any given load.

In accordance with the present invention, the $D_mN$ rating of the second bearing assembly is elevated such that for a given mill delivery speed, the permitted increase in bore diameter D will accommodate a decrease in overhang A to less than the ring diameter F. Bearing load is kept within tolerable limits by insuring that the spacing B between the bearings 16, 18 remains greater than the overhang A.

Table A is illustrative of what can be achieved at a mill delivery speed of 150 m/sec when the bore diameter of the second bearing assembly is sized with a mean diameter of 550 mm, and the bearing is operated at elevated $D_mN$ numbers in accordance with the present invention.

TABLE A

| DELIVERY SPEED (m/sec) | D (mm) | B (mm) | F (mm) | A (mm) | $D_mN$ (Brg. 18) | A/F |
|---|---|---|---|---|---|---|
| 150 | 550 | 1154 | 1200 | 991 | 1,313,028 | 0.83 |
| | | | 1170 | 958 | 1,346,695 | 0.82 |
| | | | 1125 | 908 | 1,400,564 | 0.80 |
| | | | 1075 | 854 | 1,465,706 | 0.79 |
| | | | 1035 | 811 | 1,522,352 | 0.78 |
| | | | 1000 | 773 | 1,575,633 | 0.77 |

It will be seen from Table A that by elevating the $D_mN$ rating of the second bearing assembly 18 to well above 1,000,000, a bore diameter D of 500 mm can be employed at mill delivery speeds of 150 m/sec to produce ring diameters ranging from 1,000–1,200 mm. In all cases, the overhang A is considerably less than the diameter of the rings being formed, and the distance B between the bearings 16, 18 is greater than the overhang A.

These dimensions and $D_mN$ numbers will vary depending on the delivery speed of the mill and the size of the rings being formed by the laying head. However, central to the present invention is the shortening of the overhang A to less than the ring diameter F. As a result, centroid deflection Y is minimized, thereby raising the critical resonance speed of the laying head, which in turn makes it possible to operate safely at higher speeds. Reduced overhang is made possible by substantially increasing the $D_mN$ rating of the second bearing assembly in order to obtain the benefit of a larger bore diameter. Bearing load is maintained within tolerable limits by insuring that the spacing between the bearings 16, 18 is greater than any overhang beyond the second bearing 18.

I claim:

1. In a rolling mill, a laying head for receiving a single strand product moving axially at a speed of at least 120 m/sec and for forming said product into a continuous series of rings, said laying head comprising:

a quill having a longitudinal axis;

first and second bearing assemblies encircling and supporting said quill for rotation about said axis, the centers of said first and second bearing assemblies being located respectively in first and second mutually spaced reference planes perpendicular to said axis;

means for rotating said quill about said axis; and a laying pipe carried by said quill for rotation therewith about said axis, said laying pipe having an entry section lying on said axis between said first and second bearing assemblies and into which said product is directed, and having a three dimensionally curved intermediate section leading from said entry section across said second reference plane to terminate at a delivery end from which said product emerges to form said continuous series of rings, said delivery end being spaced radially from said axis to define a circular path of travel for said delivery end around said axis and being spaced from said second plane by an overhang distance which is less than the diameter of said circular path of travel.

2. The laying head of claim 1 wherein said overhang distance is between 0.77 and 0.83 of the diameter of said circular path of travel.

3. The laying head of claim 1 wherein said second bearing assembly has a $D_mN$ number above 1,000,000.

4. The laying head of claim 1 wherein the distance between said first and second reference planes is greater than said overhang distance.

* * * * *